United States Patent [19]

Barakitis et al.

[11] Patent Number: 4,938,727

[45] Date of Patent: Jul. 3, 1990

[54] METHOD OF MANUFACTURING A GLOW DISCHARGE STARTER

[75] Inventors: Nikolaos Barakitis, Salem; Gregory Zaslavsky, Brookline, both of Mass.

[73] Assignee: GTE Products Corporation, Danvers, Mass.

[21] Appl. No.: 367,921

[22] Filed: Jun. 19, 1989

Related U.S. Application Data

[62] Division of Ser. No. 151,034, Feb. 1, 1988, Pat. No. 4,845,406.

[51] Int. Cl.[5] ..... H01J 9/38

[52] U.S. Cl. ..... 445/40; 445/55

[58] Field of Search ..... 445/9, 22, 23, 29, 31, 445/40, 41, 53, 55

[56] References Cited

U.S. PATENT DOCUMENTS

| | | | |
|---|---|---|---|
| 2,247,872 | 7/1941 | Chirelstein | 313/151 |
| 2,321,910 | 6/1943 | Hays, Jr. | 313/148 |
| 3,658,401 | 4/1972 | Files | 445/31 |
| 3,728,004 | 4/1973 | Waymouth | 445/40 |

*Primary Examiner*—Kurt Rowan

*Attorney, Agent, or Firm*—Carlo S. Bessone

[57] ABSTRACT

This invention relates to a glow discharge starter having an hermetically sealed envelope containing an ionizable medium, a bimetallic electrode including a bimetallic element having a curved portion and a free end, and a counter electrode located within the envelope. A getter holder is secured to the counter electrode and positioned adjacent the curved portion of the bimetallic element such that a first discharge gap is formed therebetween. A second discharge gap is formed between the free end of the bimetallic element and the counter electrode. The spacing of the first discharge gap is defined as being less than the spacing of the second discharge gap. A predetermined total amount of getter material is contained within the envelope including a portion thereof contained within the getter holder. Preferably, the portion of getter material contained within the getter holder is within the range of from about 25 percent to about 75 percent of the total amount of getter material. The present invention results in a glow discharge starter which has stable electrical characteristics suitable for use with higher lamp voltages and higher ambient temperatures.

6 Claims, 3 Drawing Sheets

METHOD OF MANUFACTURING A GLOW DISCHARGE STARTER

This is a divisional of co-pending application Ser. No. 07/151,034 filed on Feb. 1, 1988 now U.S. Pat. No. 4,845,406.

TECHNICAL FIELD

This invention relates in general to glow discharge starters for arc discharge lamps and more particularly to glow discharge starters intended for higher lamp voltages and higher ambient temperatures.

BACKGROUND OF THE INVENTION

A glow discharge starter is usually connected across or in parallel with an arc discharge lamp and contains a pair of electrodes. At least one of the electrodes comprises a bimetallic element which, when heated as a result of the glow discharge, bends towards the other electrode. When contact is made, the glow discharge ceases causing the bimetallic element to cool and withdraw from the contacted electrode. When contact is broken, a voltage pulse induced by the induction of the ballast, appears across the opposed electrodes of the lamp thereby initiating an arc discharge within the lamp. If the lamp ignition does not occur after the first voltage pulse, the glow discharge sequence is repeated until lamp ignition occurs.

An example of a glow discharge starter of the aforementioned type is described in the book "Light Sources" by Elenbaas, Philips Technical Library, pages 102–103. Other types of glow discharge starters are shown and described in U.S. Pat. Nos. 2,321,910 and 2,285,805.

It is known to include a mixture of materials, which may comprise barium, magnesium and thorium, within the glow discharge starter. This mixture, although referred to a getter material or getter mixture, not only removes deleterious gases that may form during processing or during operation of the glow discharge starter, but also lowers the breakdown voltage of the starter. The getter material may be supported by a getter holder which consists of a small piece of metal in which a cup is generally formed. The getter mixture is contained within the cup. During fabrication and processing of the glow discharge starter, the getter mixture contained within the cup of the getter holder is "flashed" onto the internal surface of the envelope and internal parts of the glow discharge starter. Flashing is a well known process accomplished by means of a radio frequency generator commonly referred to as a bomber. The above mentioned process creates a more effective surface for improved gettering of deleterious gases within the glow discharge starter. However, to be effective at lowering the breakdown voltage, the material must be disposed on the electrically connected active parts of the starter.

The glow discharge starter is designed such that the contacts close at a voltage chosen between the maximum lamp voltage and the minimum supply voltage (i.e., closure voltage). The contacts of the starter must also remain open at voltages less than the maximum lamp voltage (i.e., non-reclosure voltage). The development of compact fluorescent lamps, wherein the glow discharge starter is contained within the lamp base, has placed more stringent requirements on the glow starters. One of these is the requirement for reliability in a high temperature environment up to about 200 degrees Celsius. Since a glow discharge starter is a temperature-sensitive device, the increased temperature tends to change the operating characteristics of the starter by decreasing the discharge gap between the free end of the bimetallic element and the counter electrode. Some of these high temperature glow discharge starters are also required to operate with higher wattage lamps (e.g., up to 50 watts). Among newly developed are 18, 22 and 28 watt compact fluorescent lamps. To be suitable to operate these three lamps, a starter should have a minimum closure voltage of 105 volts and a maximum non-reclosure voltage of at least 85 volts. It is important that the electrical parameters of the glow discharge starter remain within this range throughout the life of the starter. A conventional glow discharge starter intended for low lamp voltage applications does not meet the temperature requirement. Temperatures above 100–120 degrees Celsius generally disable these starters. Maintaining electrical parameters within the 105/85 volt range is difficult to control.

The switching transient voltage output of the device depends upon the flexure and shape of the bimetallic element. Greater flexure distortion normally causes higher pulse voltages. During this thermal distortion, the spacing between the bimetallic element and counter electrode is decreased and adversely affects the breakdown voltage. Keeping the breakdown voltage in the desired range, requires a larger gap. This inconsistency demands compromise and often means difficulties in production and increases in cost.

A solution to improve high temperature operation is to increase the sPacing between the free end of the bimetallic element and the counter electrode. However, this solution often results in the loss of operating voltage control. For example, in a single discharge gap starter, increasing this spacing to compensate for the increase in ambient temperature, also increases the closure voltage of the starter. For high line voltage applications (i.e., 220–240 volts AC), the problem can be overcome with tight control of this spacing. However this can result in a smaller yield in production or higher cost.

Attempts have been made to avoid the above-mentioned problems by utilizing complex gases to stabilize the characteristics of the glow discharge starter during its life. These gas compositions have included light gases (e.g., helium and hydrogen) which can be absorbed by the starter envelope, getter or internal metal parts.

SUMMARY OF THE INVENTION

It is therefore, an object of the invention to obviate the disadvantages of the prior art.

It is another object of the invention to provide an improved glow discharge starter suitable for higher lamp voltages and higher ambient temperatures.

It is still another object of the invention to provide an improved method of manufacturing a glow discharge starter.

These objects are accomplished, in one aspect of the invention, by the provision of a glow discharge starter comprising an hermetically sealed envelope containing an ionizable medium, and a bimetallic electrode and a counter electrode located within the envelope. The bimetallic electrode includes a bimetallic element. A getter holder is secured to one of the electrodes ( e.g., the counter electrode ). A predetermined total amount of getter material is contained within the envelope with a portion thereof contained within the getter holder. The portion of the getter material contained within the getter holder is within the range of from about 25 percent to about 75 percent of the predetermined total amount of the getter material contained within the envelope.

In a second embodiment, a glow discharge starter is provided comprising an hermetically sealed envelope containing an ionizable medium, a bimetallic electrode and a counter electrode located within the electrode. The bimetallic electrode includes a bimetallic element having a curved portion and a free end. A getter holder is secured to the counter electrode and positioned adjacent the curved portion of the bimetallic element such that a first discharge gap having a predetermined spacing is formed therebetween. A second discharge gap having a predetermined spacing is formed between the free end of the bimetallic element and the counter electrode. The predetermined spacing of the first discharge gap is less than the predetermined spacing of the second discharge gap at 25 degrees Celsius. A predetermined total amount of getter material is contained within the envelope with a portion thereof contained within the getter holder. The portion of the getter material contained within the getter holder is within the range of from about 25 percent to about 75 percent of the predetermined total amount of the getter material contained within the envelope.

In accordance with further aspects of the invention, the predetermined spacing of the first discharge gap is within the range of from about 0.010 inch to about 0.015 inch. Preferably, the predetermined spacing of the second discharge gap is within the range of from about 0.020 inch to about 0.050 inch.

In accordance with further teachings of the present invention, the getter material contained within the getter holder is about 50 percent of the predetermined total amount of getter material contained within the envelope. In one embodiment, the portion of getter material contained within the getter holder is within the range of from about 0.25 milligram to about 0.75 milligram.

In accordance with further embodiments of the invention, the ionizable medium medium includes argon at a predetermined pressure which is preferably within the range of from about 12.0 torr to about 18.0 torr. In one embodiment, the getter holder is defined as including a getter holder strip having a getter cup formed therein or secured thereto.

In accordance with additional aspects of this invention, a method of making a glow discharge starter is provided. The method includes the steps of providing an envelope, forming a bimetallic electrode with a bimetallic element, providing a counter electrode, securing a getter holder containing a predetermined amount of getter material to one of the electrodes, sealing the bimetallic electrode and the counter electrode within the envelope, exhausting the envelope, filling the envelope with a gas at a predetermined pressure, flashing a portion of the getter material, adjusting the pressure within the envelope, and hermetically sealing the envelope.

In accordance with still further teachings of the present invention, the above method further includes the steps of providing the bimetallic element with a curved portion and a free end, forming a first discharge gap having a predetermined spacing between the getter holder and the curved portion of the bimetallic element, and forming a second discharge gap having a predetermined spacing between the free end of the bimetallic element and the counter electrode.

BRIEF DESCRIPTION OF THE DRAWINGS

The invention will become more readily apparent from the following exemplary description in connection with the accompanying drawings, wherein.

BEST MODE FOR CARRYING OUR THE INVENTION

For a better understanding of the present invention, together with other and further objects, advantages and capabilities thereof, reference is made to the following disclosure and appended claims taken in conjunction with the above-described drawings.

Figure 1:
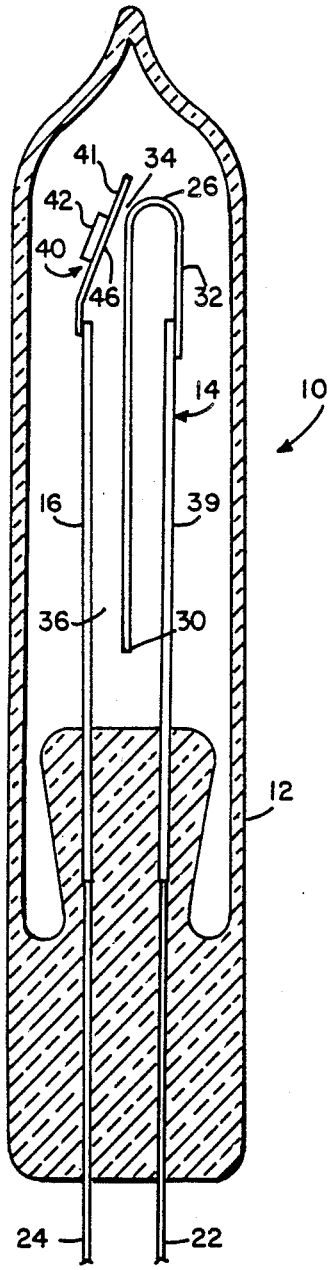
FIG. 1 is a front elevational view of an embodiment of a glow discharge starter according to the invention.

Referring now to the drawings with greater particularity, there is shown in FIG. 1 a glow discharge starter 10 comprising an hermetically sealed envelope 12 containing an ionizable medium. The ionizable medium may comprise an inert gas or combinations thereof at a low pressure typically within the range of from about 12.0 torr to about 18.0 torr. A bimetallic electrode 14 and a counter electrode 16 are located within envelope 12. Electrodes 14 and 16 are electrically connected to or as illustrated in FIG. 1, formed from lead-in conductors 22 and 24, respectively. Bimetallic electrode 14 includes a post 39 and a bimetallic element 32. Bimetallic element 32, which may include a curved portion 26 and a free end 30, consists of two strips of metal having different linear coefficients of expansion welded together. The side of higher coefficient of expansion is on the inside curve of the U so that bimetallic element 32 opens out and engages counter electrode 16. The counter electrode may be constructed as a second bimetallic electrode comprising a post and bimetallic element. The shape of the bimetallic element may vary from that shown in FIG. 1.

Further included in glow discharge starter 10 is a getter holder 40 which is preferably secured to counter electrode 16. Getter holder 40 comprises a getter holder strip 41 having a getter cup 42 formed therein or secured thereto. The opening 46 of getter cup 42 is positioned to face bimetallic element 32. Getter holder 40 is secured to counter electrode 16 by welding. Normally during fabrication and processing of the glow discharge starter, essentially all of the getter material contained within cup 42 of getter holder 40 is "flashed" onto the internal parts of the glow discharge starter. In accordance with the teachings of the present invention, a portion of the getter material remains in the getter cup subsequent to flashing and during the normal operating life of the glow discharge starter. Preferably, the amount of getter material remaining within the getter holder after processing is within the range of from about 25 percent to about 75 percent of the total amount of getter material contained within the envelope after flashing. In a preferred embodiment, about 50 percent of the total amount of getter material contained within the envelope immediately after processing remains in the getter holder. The flashed portion of the getter material is deposited on the internal portions of the glow discharge starter.

In one embodiment, getter holder 40 is positioned adjacent curved portion 26 of bimetallic element 32 such that a first discharge gap 34 having a predetermined spacing is formed. First discharge gap 34 is responsible for the electrical breakdown and heating of the bimetallic element 32 when a voltage potential is applied across lead-in conductors 22,24. The exact location of first discharge gap 34 is selected so that the gap spacing remains substantially constant during the flexure of bimetallic element 32. Typically, the spacing of first discharge gap 34 is within the range of from about 0.010 inch to about 0.015 inch. First discharge gap 34 can be adjusted by bending getter holder 40 at the knee. A second discharge gap 36 having a predetermined spacing is formed between free end 30 of bimetallic element 32 and counter electrode 16. Second discharge gap 36 can be adjusted by bending bimetallic element 32. The spacing of second discharge gap 36 changes as the result of flexure of bimetallic element 32 caused by the heating action of the discharge or changes in the ambient temperature. It has been discovered that problems associated with high ambient temperatures can be overcome by increasing the spacing of second discharge gap 36 without affecting the electrical breakdown voltage of the glow discharge starter. Typically, the spacing of second discharge gap 36 is within the range of from about 0.020 inch to about 0.050 inch. As illustrated in FIG. 1, the spacing of first discharge gas 34 is less than the spacing of second discharge gap 36 when measured at room temperature (i.e., 25 degrees Celsius).

As to the manufacture of the above-described glow discharge starters, a suitable envelope is first provided. A bimetallic electrode is formed with a bimetallic element which may include a curved portion and a free end. A getter holder containing a Predetermined amount of getter material is secured to one of the electrodes, such as the counter electrode. The electrodes are positioned and, if the dual discharge gap configuration of the Present invention is desired, the electrodes are adjusted to form a first discharge gap between the getter holder and the curved portion of the bimetallic element and a second discharge gap between the free end of the bimetallic element and the counter electrode. The bimetallic electrode and the counter electrode are sealed within the envelope. The interior of the envelope is exhausted by connecting the envelope to a vacuum system.

Normally, the envelope is pumped down to substantially a vacuum before the getter material is flashed onto the internal surface of the envelope and internal parts of the glow discharge starter by means of a radio frequency generator. However, when the interior of the envelope is near vacuum, the generator heats the electrodes (and getter holder) while the glass remains relatively cool. This may cause the majority of the getter material to adhere to the internal surface of the envelope. Alternatively, if too much material is disposed on the electrodes, a low non-reclosure voltage (i.e., 65–75 volts) may result. This requires the starter to be aged for up to a half hour to increase the non-reclosure voltage.

It has been discovered that the amount of getter material flashed out of the getter holder and the location to which the getter material is delivered can be better controlled by filling the envelope with a gas (e.g., nitrogen or an inert gas) at an intermediate pressure, for example, between about 40 torr and 100 torr before flashing. The intermediate pressure is generally higher than the final pressure of the glow discharge starter. The effect of the pressure of the intermediate gas on the amount of getter material left within the getter holder is shown in TABLE I.

TABLE I

| Pressure (torr) | Amount of Getter Material Left in Holder (%) |
|---|---|
| 40–50 | 25 |
| 80 | 50 |
| 100 | 75 |

More of the material released from the getter holder is deposited on the metal parts of the starter because the glass envelope also becomes heated.

If the intermediate gas chosen is the same as the final gas fill, the pressure within the envelope is simply adjusted so as to obtain the final pressure. If the intermediate gas is different from the final fill gas, the intermediate gas is exhausted from the envelope before the final gas is introduced and adjusted. Finally, an hermetic seal is formed by tipping off the envelope.

During operation of the glow discharge starter, the material which is deposited on the active parts of the starter becomes dislodged or evaporates. This loss of material often causes the closure voltage to increase to a point where the starter becomes inoperable. It is believed that in the present invention, the material remaining within the getter holder is gradually dispensed during operation of the starter. This leads to an increase in the life of the starter by maintaining the starter's electrical parameters within the preestablished range.

Figure 2:
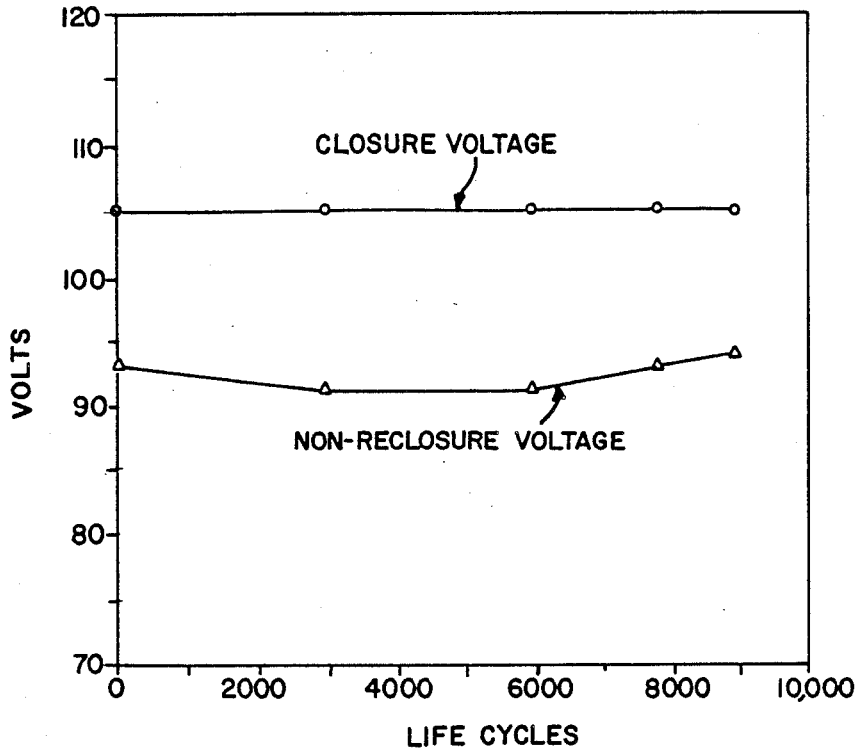
FIG. 2 is an illustration of the closure and non-reclosure voltages as a function of life cycles for starters made in accordance with the teachings of the present invention.

In a typical but not limiting example of a glow discharge starter made in accordance with the teachings of the present invention, the envelope is formed from potash soda lead glass having an outside diameter of 0.285 inch (7.2 millimeters), a wall thickness of 0.027 inch (0.69 millimeters) and an overall length of 1.1 inch (28 millimeters). The hermetically sealed envelope contained argon gas at a pressure of 15 torr. The spacing of the first discharge gap was approximately 0.010 inch (0.25 millimeters) and the spacing of the second discharge gap was approximately 0.040 inch (1 millimeter). Initially, 1.0 milligram of a mixture of 22% barium, 58magnesium, and 20thorium was contained within the getter holder. Prior to flashing the envelope was filled with argon gas at a pressure of approximately 80 torr. After flashing, about fifty percent of the mixture contained within the hermetically sealed envelope remained within the getter holder. Lifetest data on the above glow discharge starters was obtained by operating the starters on a 20 seconds on and 40 seconds off cycle. In FIG. 2, the data is plotted on the basis of "volts" as abscissa and "life cycles" as ordinate. The data show that at 9000 cycles, the closure voltage remained at 105 volts and the reclosure voltage remained greater than 90 volts. Prior art starters tested on a similar cycle failed to reach 6000 cycles.

Figure 3:
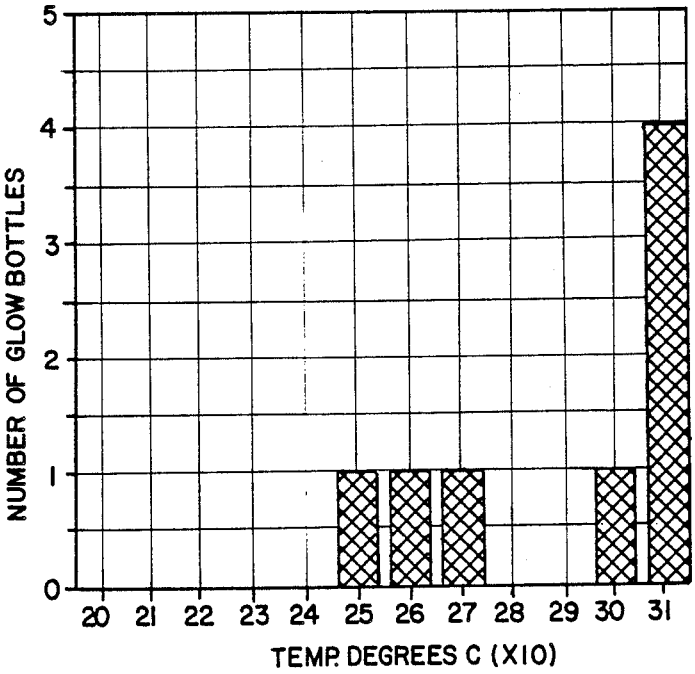
FIG. 3 is an illustration of the contact closure temperature for starters made in accordance with the teachings of the present invention.

FIG. 3 illustrates the results of a high temperature test to determined the temperature at which the contacts of the glow discharge starter finally close. The data is plotted on the basis of 'number of glow bottles" as abscissa and "temperature in degrees Celsius ( times 10)". The data show that at temperatures less than or equal to 240 degrees Celsius, all starters remained open.

While there have been shown and described what are at present considered to be the preferred embodiments of the invention, it will be apparent to those skilled in the art that various changes and modifications can be made herein without departing from the scope of the invention. The embodiments shown in the drawings and described in the specification are intended to best explain the principles of the invention and its practical application to hereby enable others in the art to best utilize the invention in various embodiments and with various modifications as are suited to the particular use contemplated.

What is claimed is:

1. The method of making a glow discharge starter comprising the steps of providing an envelope, forming a bimetallic electrode with an envelope, forming a bimetallic electrode with a bimetallic element, providing a counter electrode, securing a getter holder containing a predetermined amount of getter material to one of said electrodes, sealing said bimetallic electrode and said counter electrode within said envelope, exhausting said envelope, filling said envelope with a gas at a predetermined pressure greater than a predetermined final pressure before flashing a portion of said getter material, adjusting the pressure within said envelope to said final pressure, and hermetically sealing said envelope.

2. The method of claim 1 further including the steps of providing said bimetallic element with a curved portion and a free end, forming a first discharge gap having a predetermined spacing between said getter holder and said curved portion of said bimetallic element, and forming a second discharge gap having a predetermined spacing between said free end of said bimetallic element and said counter electrode such that the spacing of said first discharge gap is less than the spacing of said second discharge gap at 25 degrees Celsius.

3. The method of claim 1 wherein between about 25 percent to about 75 percent of said getter material is flashed.

4. The method of claim 3 wherein about 50 percent of said getter material is flashed.

5. The method of claim 1 wherein between about 0.25 milligram to about 0.75 milligram of said getter material is flashed.

6. The method of claim 1 wherein said gas is argon.

* * * * *